US008127722B2

(12) United States Patent
Justin et al.

(10) Patent No.: US 8,127,722 B2
(45) Date of Patent: Mar. 6, 2012

(54) COOLING CIRCUIT FOR THE THERMAL ENGINE OF AN AUTOMOTIVE VEHICLE

(75) Inventors: Thomas Justin, Brignais (FR); Frederic Demarle, Villefontaine (FR)

(73) Assignee: Renault Trucks, Saint Priest (FR)

( * ) Notice: Subject to any disclaimer, the term of this patent is extended or adjusted under 35 U.S.C. 154(b) by 210 days.

(21) Appl. No.: 12/439,205

(22) PCT Filed: Sep. 22, 2006

(86) PCT No.: PCT/FR2006/050939

§ 371 (c)(1),
(2), (4) Date: Feb. 27, 2009

(87) PCT Pub. No.: WO2008/034959

PCT Pub. Date: Mar. 27, 2008

(65) Prior Publication Data

US 2010/0012054 A1 Jan. 21, 2010

(51) Int. Cl.
*F01P 7/14* (2006.01)

(52) U.S. Cl. ..... 123/41.1; 123/41.11

(58) Field of Classification Search ..... 123/41.1, 123/41.11

See application file for complete search history.

(56) References Cited

U.S. PATENT DOCUMENTS

| | | | | | |
|---|---|---|---|---|---|
| 3,752,132 | A * | 8/1973 | Bentz et al. | ..... | 123/563 |
| 4,180,032 | A * | 12/1979 | Plegat | ..... | 123/563 |
| 4,520,767 | A * | 6/1985 | Roettgen et al. | ..... | 123/41.1 |
| 4,911,110 | A * | 3/1990 | Isoda et al. | ..... | 123/41.14 |
| 5,036,803 | A * | 8/1991 | Nolting et al. | ..... | 123/41.1 |
| 5,215,044 | A * | 6/1993 | Banzhaf et al. | ..... | 123/41.29 |
| 6,047,770 | A * | 4/2000 | Suzuki et al. | ..... | 165/202 |
| 6,564,757 | B2 * | 5/2003 | Suzuki et al. | ..... | 123/41.14 |
| 6,634,323 | B2 * | 10/2003 | Vaudry et al. | ..... | 123/41.1 |
| 7,214,715 | B2 * | 5/2007 | Beck et al. | ..... | 514/616 |
| 7,261,068 | B1 * | 8/2007 | Wantschik | ..... | 123/41.29 |
| 2003/0094147 | A1 * | 5/2003 | Hoelle et al. | ..... | 123/41.44 |

FOREIGN PATENT DOCUMENTS

| | | | |
|---|---|---|---|
| DE | 1223196 | B | 8/1966 |
| DE | 10228355 | A | 1/2004 |
| DE | 20403270 | A | 8/2004 |
| EP | 0499071 | A | 8/1992 |
| EP | 1201889 | A | 5/2002 |
| EP | 1295740 | A1 | 3/2003 |
| GB | 2401167 | A | 11/2004 |
| JP | 2004360460 | A | 12/2004 |

OTHER PUBLICATIONS

International Search Report for corresponding International Application PCT/FR2006/050939.

* cited by examiner

*Primary Examiner* — Noah Kamen
*Assistant Examiner* — Long T Tran
(74) *Attorney, Agent, or Firm* — WRB-IP LLP

(57) ABSTRACT

A cooling circuit for the thermal engine of an automotive vehicle includes a main loop that includes a first exchanger for collecting the heat from a first heat source, a first radiator and a pump connected in series by ducts for the circulation of a cooling liquid, the temperature of the cooling liquid being kept under normal operation conditions at a temperature lower than or equal to a predetermined threshold value. The cooling circuit includes a first bypass of the main loop in parallel relative to said first radiator, the first bypass including sequentially, in the circulation direction of the cooling liquid, a second exchanger for collecting the heat from a second heat source and a second radiator connected in series by ducts for the circulation of the cooling liquid, the temperature of said cooling liquid at the outlet of said second exchanger being set, under normal operation conditions, at a temperature higher than or equal to the predetermined threshold value.

12 Claims, 2 Drawing Sheets

COOLING CIRCUIT FOR THE THERMAL ENGINE OF AN AUTOMOTIVE VEHICLE

BACKGROUND AND SUMMARY

The invention relates to the field of the cooling of the combustion engines of motor vehicles such as private cars, trucks, buses or site plant. A cooling circuit generally passes through a number of mechanical parts that are to be cooled and may also be used to heat up certain elements that consume heat energy, these being connected by pipes or other flexible or rigid ducts through which a heat-transfer fluid commonly known as liquid coolant flows.

The invention relates more specifically to a special arrangement of the cooling circuit that is aimed at dissipating the heat to the atmosphere more effectively and at improving the overall efficiency of heat exchanges between the various mechanical parts of the motor vehicle and those elements of the motor vehicle that require heating.

In general, a motor vehicle combustion engine cooling circuit comprises a so-called "high temperature" main circuit used to cool and to regulate the temperature of the combustion engine. A main circuit such as this thus comprises a radiator capable of removing the heat energy given off by the engine and carried by the coolant. This radiator allows exchange of heat with an ambient air flow that is dependent on the speed of the vehicle and/or on whether or not the fan is running. A pump also forms part of this main circuit and adapts the rate of flow of liquid coolant through the circuit. A thermostat arranged on the main circuit allows the radiator to be short circuited and thus allows the coolant to heat up more quickly.

What is more, the main engine cooling circuit may also be used for various applications and, in particular, to cool various pieces of equipment. Included among these elements are, for example and in particular, a condenser of the air-conditioning circuit that air conditions the cab or cabin of the motor vehicle, and also an exchanger in the engine cooling oil circuit, the gearbox cooling oil circuit, the supercharging or boost compressed air circuit or alternatively the circuit that recirculates the exhaust gases, also known as the EGR (Exhaust Gas Recirculation) circuit.

In order to cool these various elements, secondary circuits may therefore be connected to the main cooling circuit. The liquid coolant may, in a first embodiment as described in document FR 2 832 185, pass through a radiator dedicated to this secondary loop in order to drop its temperature below that of the coolant in the main circuit. The coolant then passes through the equipment that is to be cooled. A secondary loop such as this is generally known by the name of "low temperature loop" because the temperature of the coolant is lowered before it is used to cool a piece of equipment.

However, the various items of equipment that need to be cooled do not need low-temperature cooling and may be cooled by the main so-called "high-temperature" circuit. Thus, the exhaust gas recirculation (EGR) system may be cooled directly using the coolant flowing through the main loop, the maximum temperature of which is of the order of 110° C. This is because the circuit for cooling the recirculated gases needs to be able to drop the temperature of the exhaust gases from a temperature of 600° C. to around 180° C., and a fluid at 110° C. is therefore able to perform such cooling. The same is true of the supercharging air cooling circuit that needs to be capable of cooling the compressed air, which leaves the compressor at an outlet temperature of around 200° C. to 250° C.

Thus, in this prior art, the ventilation air, in the radiators, removes all of the heat energy generated by the heat sources.

The air cannot, however, be heated above the temperature of the coolant present in the main circuit.

According to another prior art, the secondary circuits may also be devoid of radiators. In this case, the radiator of the main circuit has to remove the additional heat supplied to the coolant.

However, it then becomes necessary to increase the heat exchange area of the radiator, and this may prove to be incompatible with the space available at the front end of the vehicle.

Also known, and as described in document U.S. Pat. No. 5,244,256, are motor vehicle cooling circuits comprising two separate cooling loops, one specifically devoted to cooling the exhaust gas recirculation (EGR) device.

However, a set-up such as this entails duplicating elements specific to each independent cooling loop, such as pumps and expansion vessels.

Thus, it is desirable to improve the cooling of a thermal installation formed of an engine and all its auxiliary equipment.

It is also desirable to reduce the number of elements, particularly by using a single pump, a single expansion vessel and a single degassing system for both cooling circuits.

The invention therefore relates, according to an aspect thereof, to a motor vehicle combustion engine cooling circuit comprising a main loop comprising a first exchanger that collects the heat from a first heat source. This exchange is generally performed within passages created in the engine block in the region of the cylinders or in the cylinder head in the region of the combustion chambers. The main loop also comprises a first radiator and a pump that enables a sufficient flow rate to be created that the heat energy given off by the combustion within the engine can be removed. The various elements of the main loop are connected in series using hoses through which the liquid coolant can flow. Under normal operating conditions, the temperature of the liquid is kept at a temperature lower than or equal to a predetermined threshold value.

According to an aspect of the invention, the cooling circuit is characterized in that it comprises a first bypass of the main loop arranged in parallel with the first radiator. This first bypass comprises, in succession, in the direction in which the coolant flows, a second exchanger collecting heat from a second heat source and a second radiator, these being connected in series by means of hoses through which the coolant can flow. Under normal operating conditions, the temperature of the coolant leaving the second exchanger is raised to a temperature higher than or equal to the predetermined threshold value.

In other words, the coolant heated as it passes through the ducts in the combustion engine is used to cool or heat directly specific equipment of the vehicle using a coolant at a higher temperature. The fact of the matter is that some equipment does not require the use of a coolant the temperature of which is regulated below the predetermined threshold value. The coolant in this bypass is therefore raised to a temperature higher than that of the coolant in the main loop. Thus, the main loop can be termed a "high-temperature" loop, while the bypass can be termed "a very-high-temperature" bypass.

More specifically, in the main loop, the temperature of the coolant needs to be kept below the predetermined threshold value of about 110° C. Overheating of the engine could have detrimental effects on the engine gaskets or alternatively on the internal clearances that allow the pistons to slide inside the cylinders, and in general on the lubrication of the various mechanical moving parts. However, the various pieces of equipment connected to this "very-high-temperature" bypass do not require such temperature regulation and are able to withstand far higher temperatures. Thus, the temperature of the coolant leaving the second exchanger is higher than the temperature of the coolant in the main circuit, at nominal speed and load.

A cooling circuit such as this therefore makes it possible to improve the exchange of heat between the ventilation air passing through the radiators and the coolant by virtue in particular of the increase in temperature difference between these two fluids.

As has already been mentioned, the heat sources, some of the heat energy from which is removed in the second exchanger, may be of differing natures. The various sources may therefore be used independently or in combination according to various embodiments of the second exchanger.

According to a first embodiment of the invention, the second heat source of the second exchanger may comprise a circuit of the exhaust gas recirculation system.

In this case, the second exchanger is, for example, of the liquid/gas type in which the gases released during combustion within the engine are collected and cooled using the exchanger reducing them from a temperature of about 600° C. to about 180° C. This reduction in temperature is due to the exchange of heat with the liquid coolant entering the first bypass of the main loop of the cooling circuit. On leaving the second exchanger, the liquid coolant is therefore at a higher temperature than in the main circuit.

According to a second embodiment, the second heat source of the second exchanger may comprise a circuit of the combustion engine lubricating oil. In this case, the second exchanger is of the liquid/liquid type in which the liquid coolant is heated by the engine lubricating oil.

According to a third embodiment, the second heat source of the second exchanger may comprise a supercharged (boost) compressed air circuit.

In this case, the second exchanger is, for example, of the liquid/gas type in which the liquid coolant stores heat energy carried by the air compressed beforehand by a device of the compressor or turbocharger type since the temperature of the air leaving this type of device is generally of the order of 200 to 250° C.

These various embodiments may, when combined, be incorporated into one single multiple-duct exchanger capable of carrying several fluids and which are separated by means of a heat-exchange surface. Numerous types of exchanger may in particular be used, for example heat exchangers of the "plate"-type or tube-type beat exchangers.

The use of a separate radiator for the bypass improves the efficiency of the exchange of heat between the air and the fluid that is to be cooled which is at a higher temperature. This is because for a given rate of flow of ventilating air, this independent radiator is able to dissipate a greater amount of heat by increasing the temperature difference between the inlet and outlet of the exchangers. In addition, this arrangement makes it possible to reduce the size of the main circuit radiator.

What is more, the radiators of the main loop and of the "very-high-temperature" bypass may be positioned in various ways relative to one another.

According to a first alternative form, these radiators may be arranged, in terms of air flow, in series. In this case, the air collected by the front end of the vehicle passes in succession between the cooling fins of the radiator of the main loop then of the first bypass. In other words, the two radiators are positioned one behind the other, for example perpendicular to the direction of travel of the vehicle that corresponds to the direction of air flow.

In this case, the air used to cool the second radiator is at a temperature higher than that of the external air, namely for example about 100° C. when the external air is at 40° C. This increase in air temperature is not, however, detrimental, because the liquid coolant flowing through the second radiator is also at a higher temperature. Thus the air, even heated, is able to cool the liquid coolant in the second radiator.

Furthermore, the second radiator preferably has dimensions smaller than or equal to those of the first radiator and thus does not increase the widthwise and heightwise size of the air collecting surface on the front end of the vehicle. Thus, for the same overall frontal surface area, a cooling circuit such as this comprising a "very-high-temperature" bypass is able to increase the dissipated thermal energy.

According to a second alternative form, the first and second radiators may be arranged, in terms of air flow, in parallel. In this case, the two radiators may be cooled by separate air flows, leading to an overall exchange area that is greater than the largest dimension of the two radiators. This arrangement does, however, improve the overall cooling efficiency since, in this case, the air flow passing through the two radiators is at the same temperature that corresponds to the temperature of the external surroundings.

The two radiators may also be cooled by one and the same flow of air which is diverted after passing through the first radiator. In this case, the air flow passing through the second radiator is at a temperature higher than that of the air flow passing through the first radiator.

In order to improve the speed at which the liquid coolant comes up to temperature in the main loop, a thermostat may be fitted to this loop in order to regulate the rate of flow of liquid coolant according to its temperature.

According to a first embodiment, the first bypass may be arranged downstream, in the direction in which the coolant flows, of the thermostat arranged on the main circuit. In this case, when the thermostat shuts off the flow of liquid coolant through the first radiator, it at the same time shuts off the flow of liquid coolant through the first bypass. The coolant is therefore not cooled and flows through the first exchanger in a closed circuit.

In a second embodiment, the first bypass may be arranged upstream, still in the direction in which the coolant flows, of a thermostat arranged on the main circuit. In this case, when the thermostat is actuated, the coolant no longer flows through the first radiator but may, however, flow through the first bypass.

Advantageously, in this case, the first bypass may comprise a second thermostat. Thus it is possible to increase the speed with which the liquid coolant is heated, by allowing it to flow only through the first and second heat exchangers without being cooled in the first and second radiators.

Furthermore, the first bypass may comprise a regulating valve. A valve such as this then allows the rate of flow of coolant through the first bypass to be regulated.

According to one particular embodiment, the cooling circuit may comprise a second bypass of the main loop, arranged in parallel with respect to the first radiator and to the first heat exchanger, it being possible for this second bypass to have, in succession, in the direction in which the coolant flows, a third radiator and a third exchanger collecting heat from a third heat source, these being connected in series by means of hoses through which the coolant can flow.

What happens is that the cooling circuit may also comprise a second bypass able to supply heat at a temperature lower than that of the first loop. This second bypass then acts as a "low-temperature" bypass. In this case, the supercharging air can be cooled notably in two stages. A first cooling using the second exchanger of the "very-high-temperature" first bypass brings about a first drop in temperature on contact with the high-temperature coolant. A second cooling of the supercharging air in the third exchanger of the second bypass profits from a low-temperature coolant. Similar cycles, which comprise using the second exchanger as a "pre-cooler" and the third exchanger as a "cooler" may also be used to cool the engine oil or the exhaust gases of the EGR system.

In practice, the first bypass may also comprise a fourth heat exchanger connected to a circuit for heating the air with which the cab or cabin of the vehicle is ventilated.

This is because, and particularly in winter, it may be necessary to heat the cab or cabin of the vehicle quickly. This heat exchanger may be arranged in parallel with the second radiator, particularly at the outlet from the second heat exchanger of the high-temperature loop. This is because in such an instance the coolant is raised to a very high temperature before it enters the fourth heat exchanger. This supply of heat energy may, in particular, improve the efficiency of the heat transfer.

BRIEF DESCRIPTION OF THE FIGURES

The way in which the invention is afforded together with the ensuing advantages will become clear from the description of the embodiment which follows, given by way of non-limiting indication and with the support of the attached figures in which.

DETAILED DESCRIPTION

As already mentioned, the invention relates, according to an aspect thereof, to a motor vehicle combustion engine cooling circuit. A circuit such as this may, in particular, be found in the engine compartment of a car, a truck, a coach, a bus or a site vehicle in particular.

Figure 1:
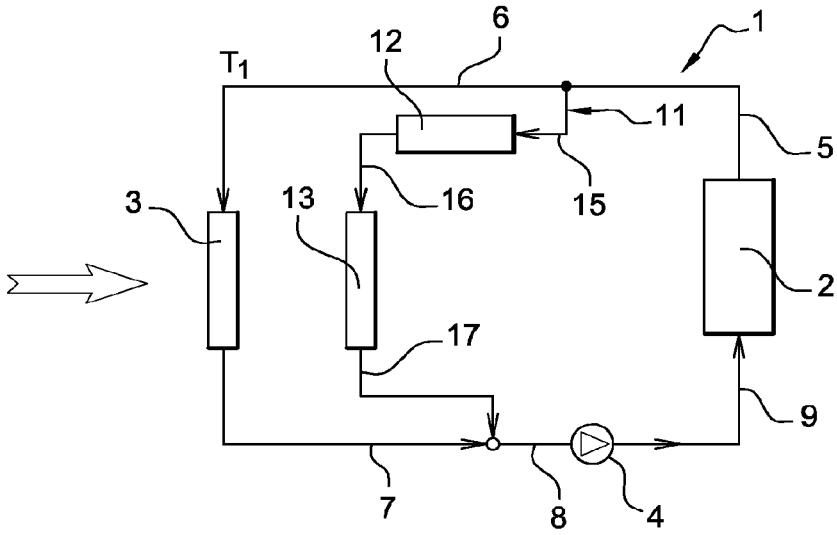
FIG. 1 is a schematic depiction of a cooling circuit according to an aspect of the invention.

As depicted in FIG. 1, the cooling circuit can be broken down into a main loop 1 to which there is attached a bypass 11. The main loop 1 comprises a first exchanger 2 that collects heat from a first heat source, a radiator 3 and a pump 4. These various elements are connected in series using hoses 5, 6, 7, 8, 9. Thus, the pump 4 is able to circulate the coolant both through the main loop 1 and through the first bypass 11. What is more, the pump 4 may be positioned at any location in the main loop 1 or in one of its bypasses.

The first bypass 11 is thus arranged in parallel with the first radiator 3. T-pieces are therefore positioned at the junction between hoses 5 and 6, and 7 and 8, to connect the hoses 15 and 17 of the first bypass 11 with the main loop 1. The downstream end of the bypass 11 thus emerges between the outlet from the radiator 3 and the inlet to the first exchanger 2.

This first bypass 11 comprises a second exchanger 12 collecting heat from a second heat source and a second radiator 13. These two elements are connected in series using the hose 16.

In the main loop 1, the temperature of the coolant must not exceed a predetermined threshold value T0, generally 110° C. Thus, the temperature of the liquid coolant leaving the first heat exchanger 2, and therefore in the hoses 5, 6 and 15, is regulated to the temperature T1.

What is more, because of the circulation of coolant through the second heat exchanger 12, the temperature T2 of the coolant in the hose 16 downstream of the second exchanger 12 is higher than the temperature T1 of the coolant in the hose 15 upstream thereof. Now, when the vehicle is under normal operating conditions, the temperature T1 of the coolant in the main loop is substantially equal to the threshold value T0. As a result, the temperature T2 of the coolant in the bypass 11 is higher than or equal to the predetermined threshold value T0 once the engine has come up to temperature.

Furthermore, and as depicted in this embodiment, the first and second radiators 13 may be arranged, in terms of air flow, in series. Thus, the flow of air passing through the first radiator 3 then passes through the second radiator 13 without any need to divert it. The outside temperature may, under extreme conditions, be about 40° C. This temperature is then raised after passing through the first radiator 3. This particular arrangement of the two radiators 3, 13, one lying behind the other, limits the surface area needed for collecting air on the front end of the vehicle.

Figure 2:
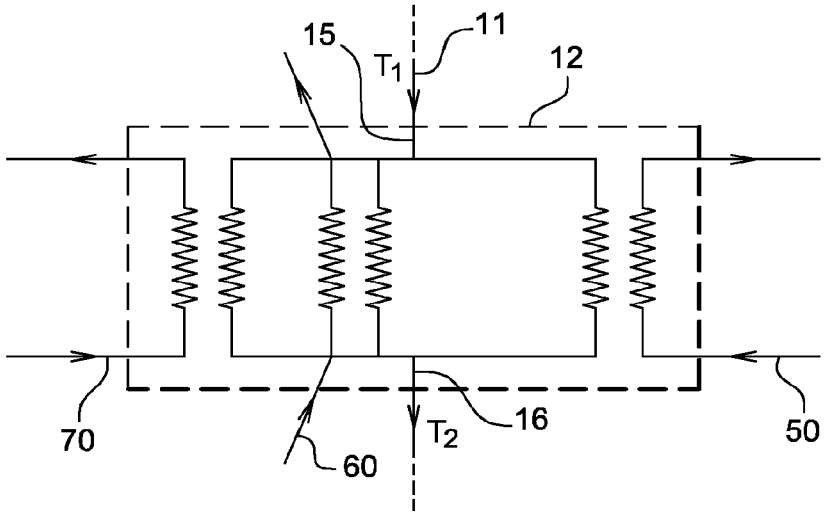
FIG. 2 is a schematic depiction of a second heat exchanger collecting the heat given off by various parts of the vehicle.

As has been depicted in FIG. 2, the second heat exchanger 12 positioned on the bypass 11 can collect heat from a number of different heat sources arranged in parallel or in series. The heat energy collected by the coolant in this exchanger 12 raises the temperature of the liquid coolant in the hose 16 from the temperature T1 to the temperature T2.

The heat source or various heat sources may be formed by, in particular, a circuit 50 of the exhaust gas recirculation system and/or a circuit 60 of the combustion engine lubricating oil and/or a supercharging (boost) compressed air circuit 70. This is because the temperature of these fluids is far higher than the temperature T1 of the liquid coolant. The temperature difference by comparison with the coolant in the high-temperature loop is great enough to provide satisfactory cooling of the coolant in the second radiator. In this way, the overall efficiency of the exchange of heat between the various heat sources and the ventilation air is improved.

Figure 3:
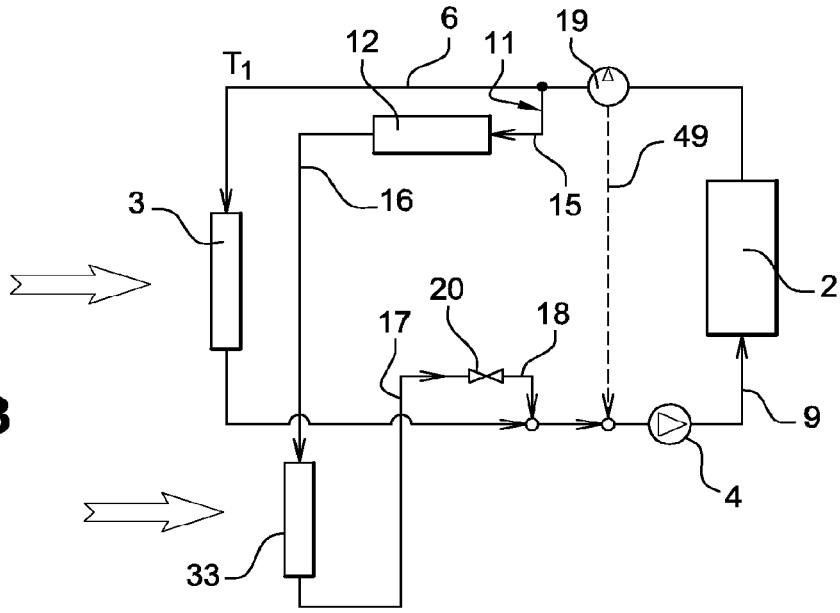
FIGS. 3 to 5 depict various alternative forms of the cooling circuit according to an aspect of the invention.

As depicted in FIG. 3, the second radiator 33 of the bypass 11 may also be offset sideways with respect to the rear surface of the first radiator 3. In this case, the flow of air passing through the first radiator 3 can either be deflected so that it cools the second radiator 33, or discharged directly. When the external air is used to cool the second radiator 33, the amount of heat removed for the same collection area is increased. What happens is that the ventilation air can be collected laterally with respect to the front end of the vehicle and this arrangement makes it possible to improve the efficiency of the exchange of heat in the "very-high-temperature" loop.

Furthermore, the first bypass 11 may comprise a regulating valve 20 that regulates the rate of flow of coolant through the first bypass 11. This regulating valve 20 is able, when closed, to cause the liquid coolant in the exchanger 12 to heat up very rapidly. When the valve 21 is open, the exchanger 12 then dissipates a maximum amount of heat energy.

Furthermore, the main loop 1 may comprise a thermostat 19, the first bypass 11 being arranged downstream of this thermostat 19. A thermostat 19 such as this can increase the speed with which the liquid coolant comes up to temperature in the main loop 1 by means of a hose 49 "short-circuiting" the first radiator 3 and the first bypass 11. Thus, the first heat exchanger 2 is in a closed circuit with the pump 4 and the heat stored up by the coolant is not exchanged with the air of the external surroundings.

Figure 4:
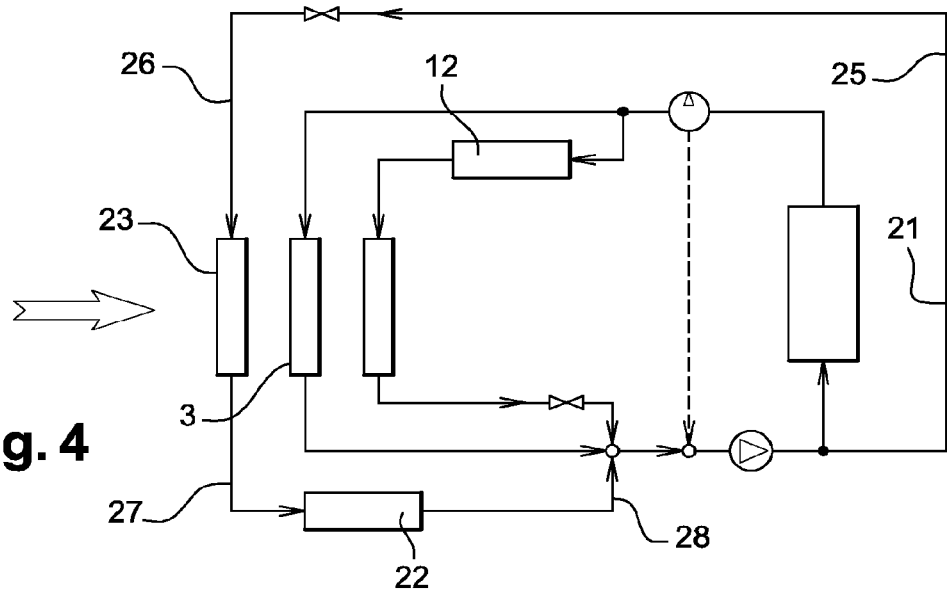

As has been depicted in FIG. 4, the cooling circuit may also comprise a second bypass 21 arranged in parallel with the first heat exchanger 2 and with the first radiator 3 of the main loop 1. This second bypass 21 comprises, in succession, a third radiator and a third exchanger 22 collecting heat from a third heat source. These two elements are connected in series by means of the hose 27 and are connected to the main loop 1 by means of three hoses 25, 26 and 28. This second bypass 21 can be used in particular to lower the temperature of the liquid coolant that has been regulated in the main loop at a temperature T1, so as to cool a fluid which may, in particular, be a gas or a liquid, in the third heat exchanger 22. In this configuration, the second heat exchanger 12 may act as a "pre-cooler" for the supercharging (or boost) compressed air, the third heat exchanger 2 then being used as a "cooler" on the outlet side of the "pre-cooler".

The three radiators 3, 13, 23 may be arranged in various configurations, namely, in terms of air flow, they may be in series or in parallel.

Figure 5:
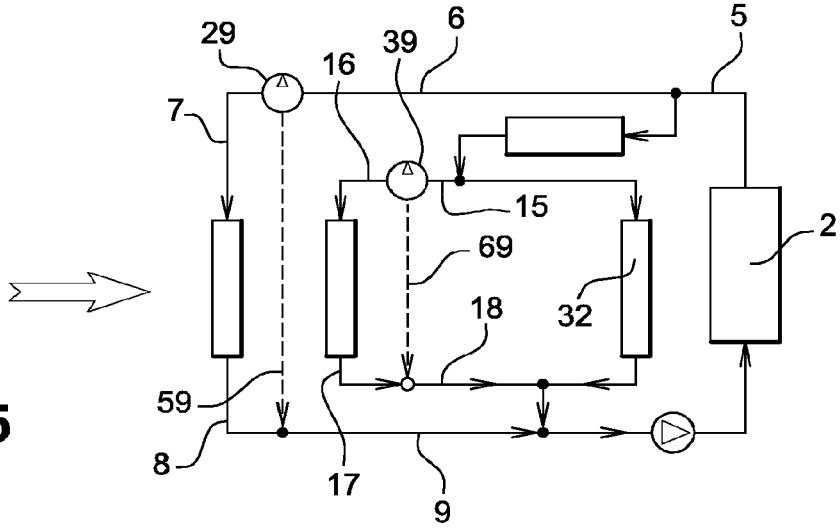

As depicted in FIG. 5, the first bypass 11 may be arranged upstream of the first thermostat 29 arranged on the main circuit 1. In this way, when the first radiator 3 is "short-circuited" using the hose 59, the coolant enters the first bypass 11 and, in particular, passes through the second heat exchanger 12. This increases the speed with which the temperature of the coolant is increased because it is no longer cooled by the first radiator 3 of the main loop 1.

Furthermore, a second thermostat 39 may be arranged within the first bypass 11. This second thermostat 39 allows the second radiator 13 to be "short-circuited" using a hose 69 that connects the hose 15 directly to the hose 18.

Furthermore, a fourth heat exchanger 32 may be arranged in parallel with the second radiator 13 in the first bypass 11 downstream of the second exchanger. This fourth heat exchanger 32 may be connected to a circuit that heats the air with which the cab or cabin of the vehicle is ventilated.

This embodiment in particular makes it possible to heat the cab or cabin rapidly, something that may prove advantageous in order quickly to deice a windshield or simply improve comfort in the vehicle. It also improves the efficiency of the exchange of heat in the fourth exchanger 32 because the fluid passing through it is at a temperature higher than that of the main loop 1 on which it is generally arranged.

It is clear from the foregoing that a cooling circuit according to an aspect of the invention displays numerous advantages and, in particular:

it improves the overall efficiency of an exchange of heat generated by all the equipment in the vehicle that produces heat or requires heating;

for the same efficiency, it enables the surface area required for collecting fresh air at the front surface of the vehicle to be reduced;

it improves the overall comfort of the vehicle by improving the speed with which the cab or cabin in particular heats up.

The invention claimed is:

1. A cooling circuit for a motor vehicle combustion engine, comprising a main loop comprising:

a first exchanger that collects the heat from a first heat source, a first radiator and a pump which are connected in series using hoses through which a liquid coolant can flow, a temperature of the coolant being, under normal operating conditions, kept at a temperature lower than or equal to a predetermined threshold value, a first bypass of the main loop arranged in parallel with the first radiator, the first bypass comprising, in succession, in a direction in which the coolant flows, a second exchanger collecting heat from a second heat source and a second radiator, the second radiator and the second exchanger being connected in series by hoses through which the coolant can flow, a second exchanger coolant temperature of the coolant leaving the second exchanger being, under normal operating conditions, raised to a temperature higher than or equal to the predetermined threshold value.

2. The cooling circuit as claimed in claim 1, wherein the second heat source of the second exchanger comprises a circuit of the exhaust gas recirculation system.

3. The cooling circuit as claimed in claim 1, wherein the second heat source of the second exchanger comprises a circuit of the combustion engine lubricating oil.

4. The cooling circuit as claimed in claim 1, wherein the second heat source of the second exchanger comprises a supercharged compressed air circuit.

5. The cooling circuit as claimed in claim 1, wherein the first and second radiators are arranged, in terms of air flow, in series.

6. The cooling circuit as claimed in claim 1, wherein the first and second radiators are arranged, in terms of air flow, in parallel.

7. The cooling circuit as claimed in claim 1, wherein the first bypass is arranged downstream, in the direction in which the coolant flows, of a first thermostat arranged on the main circuit.

8. The cooling circuit as claimed in claim 1, wherein the first bypass is arranged upstream, in the direction in which the coolant flows, of a first thermostat arranged on the main circuit.

9. The cooling circuit as claimed in claim 8, wherein the first bypass comprises a second thermostat.

10. The cooling circuit as claimed in claim 1, wherein the first bypass comprises a regulating valve.

11. The cooling circuit as claimed in claim 1, comprising a second bypass of the main loop, arranged in parallel with respect to the first radiator and to the first heat exchanger, the second bypass comprising, in succession, in the direction in which the coolant flows, a third radiator and a third exchanger collecting heat from a third heat source, these being connected in series by means of hoses through which the coolant can flow.

12. The cooling circuit as claimed in claim 1, wherein the first bypass comprises a fourth heat exchanger connected to a circuit for heating the air with which the cab or cabin of the vehicle is ventilated.

* * * * *